US005082998A

United States Patent [19]

Yoshioka

[11] Patent Number: 5,082,998

[45] Date of Patent: Jan. 21, 1992

[54] SWITCHING POWER SUPPLY FOR MICROWAVE OVEN

[75] Inventor: Hitoshi Yoshioka, Kawasaki, Japan

[73] Assignee: Yutaka Electric Mfg. Co., Ltd., Japan

[21] Appl. No.: 606,283

[22] Filed: Oct. 31, 1990

[30] Foreign Application Priority Data

Jan. 16, 1990 [JP] Japan ..... 2-6792

[51] Int. Cl.[5] ..... H05B 6/68; H02M 7/5383

[52] U.S. Cl. ..... 219/10.55 B; 363/19; 363/37

[58] Field of Search ..... 363/18, 19, 20, 131, 363/21, 37; 219/10.55 B

[56] References Cited

U.S. PATENT DOCUMENTS 3,562,623 2/1971 Farnsworth ..... 320/1
3,973,165 8/1976 Hester ..... 331/86
4,628,284 12/1986 Bruning et al. ..... 331/86
4,939,632 7/1990 Plagge et al. ..... 363/19
5,010,468 4/1991 Nilssen ..... 363/37

FOREIGN PATENT DOCUMENTS 87674 5/1985 Japan ..... 363/18
313887 12/1989 Japan ..... 219/10.55 B

*Primary Examiner*—William H. Beha, Jr.
*Attorney, Agent, or Firm*—Lowe, Price, Leblanc & Becker

[57] ABSTRACT

The present invention relates to a switching power supply for a microwave oven in which a DC power is changed to a pulse by means of a switching element coupled to a primary winding of an inverter transformer to supply the power to a high frequency oscillator (hereinafter referred to as the magnetron) coupled to a secondary winding. The inverter transformer has a supplementary winding which is coupled to control side of the switching element to form a self-excited voltate resonance type. As to the self-excited type, a switching frequency is changed by itself relative to the change of the input voltage and output power for stabilizing the output, thereby realizing same level of operation as a power switching circuit compulsory excited from outside control circuit (hereinafter referred to as The Outside-excited type).

2 Claims, 7 Drawing Sheets

SWITCHING POWER SUPPLY FOR MICROWAVE OVEN

BACKGROUND OF THE INVENTION (1) Field of the Invention

The present invention relates to a switching power supply of the voltage resonance type which is used as an inverting switching power supply of a microwave oven.

(2) Description of the Prior Art

In order to obtain a large amount of power output in a small size, a switching power supply of voltage resonance type has been used. Such a power supply is illustrated in FIG. 7 and is formed by adapting a parallel resonance of a resonance capacitor (1) and an inductance (L) of a leakage transformer (2) which functions as an inverter transformer. Such a system is used even though it only has an efficiency of about 50% of a magnetron. As is known, such a voltage resonance type switching power supply fixes an OFF period relative to an input voltage (Vin) based on the value of the resonance frequency $$f = \frac{1}{2\pi\sqrt{LC}}.$$

After the resonance voltage which is applied on a switching element (3) is lowered to OV, switching element (3) is energized. Therefore, it is possible to obtain an improved power circuit having a small amount of switching loss and a high conversion efficiency.

However, as mentioned above, since the OFF period is fixed by the resonance frequency and the output is stabilized by changing the ON period in the voltage resonance type switching power supply, it is necessary to make large changes in the switching frequency. Therefore, a PWM (Pulse Width Modulation) system which was used for the conventional switching power supply cannot be used. Accordingly, a conventional voltage resonance type switching power supply has to contain extremely complicated control circuit. Namely, circuits are required for turning the switching element (3) to ON or OFF state relative to a reference signal. Circuits which are required for the externally excited type of power supply are, as shown in FIG. 7, a rectifying and smoothing circuit (4) for the input power, the switching element (3), the inverter transformer (2), a magnetron (5), voltage detecting circuit (6) for detecting whether the voltage of switching element (3) is lowered to OV, a circuit (7) for setting the ON period of the switching element (3), a V/F converter (8) for adjusting switching frequency which forms a reference at high speed to obtain the above noted ON period, a power detecting circuit (9) for detecting magnetron power, and a circuit (11) comprising essentially a pulse transformer for insulating the control signal fed to a control circuit (10). Since the microwave oven is an article used by many people and it is required to satisfy the contradictory conditions of high reliability and low cost, it is necessary to realize the oven using simple circuits as much as possible. Since the conventional inverter circuit for microwave oven used the voltage resonance type switching power supply, the control circuit had to be complicated. Further, since a small signal was defined as a reference signal, it was necessary to protect against an error caused by external noise. Therefore, peripheral circuits were required to be added as protective circuits, thereby causing a limitation in the criteria of high reliability and low cost.

The object of the present invention is to provide an improved switching power supply for a microwave oven having high reliability and low cost without any usage of complicated control circuit.

Other objects of the present invention will be clarified by the following explanation.

BRIEF SUMMARY OF THE INVENTION

The present invention relates to a switching power supply for a microwave oven in which DC power is changed to pulsed power by means of a switching element coupled to a primary winding of an inverter transformer in order to supply the power to a magnetron coupled to a secondary winding. The inverter transformer has a supplementary winding, which is coupled to a control side of the switching element, to form a self-excited voltage resonance type of power supply.

The switching element starts to turn on by a starting circuit and the current is found by the following formula where the input voltage is defined as Vin and IQ1 is the collector current of the switching element.

$$IQ1 = \frac{Vin}{L} \cdot t$$

Thus, the current of switching element increases linearly from 0 with a slope determined by an inductance of the inverter transformer. The increment of the primary winding current of the inverter transformer which is inserted in series with this switching element, is added for establishing the ON state of the switching element from the electro-magnetic coupled supplementary winding, thereby supplying power to output side.

The OFF period is determined by a DC amplification factor (hereinafter referred to as a Hfe) of the switching element, and the switching element is cut off suddenly at the time when the collector current can no longer flow, thereby stopping the output. The important point in this case is that the externally excited type of power supply needs to have a V/F converter in order to change the switching frequency at high speed. However, as to the self-excited system, as clear from a conventional ringing choke converter (hereinafter referred to as a RCC), the switching frequency is changed by itself to counteract changes of the input voltage and output power thus stabilizing the output and thereby realizing the same level of operation as that of the externally excited type.

Further, the RCC circuit is improved and a resonance capacitor is added. Even in the case of a semi-resonance action which does not positively use resonance action with inductance of the inverter transformer, the voltage between the collector and emitter of the switching element (hereinafter referred to as a VQ1) takes the semi-resonance action with the inductance of the inverter transformer when it turns to the ON state in which the driving current does not flow, and oscillates around Vin. Thus, a turn on point of the switching element having good conversion, efficiency exists. By enhancing such a condition to achieve a complete resonance, VQ1 of the switching element is lowered to OV. If this switching element is turned on at this point, a zero crossing can be achieved, thereby realizing a high efficiency power conversion circuit without any switching loss.

As mentioned above, the RCC circuit basically has the function of V/F conversion and is an excellent circuit suitable for the voltage resonance type switching power supply.

DETAILED DESCRIPTION

Figure 1:
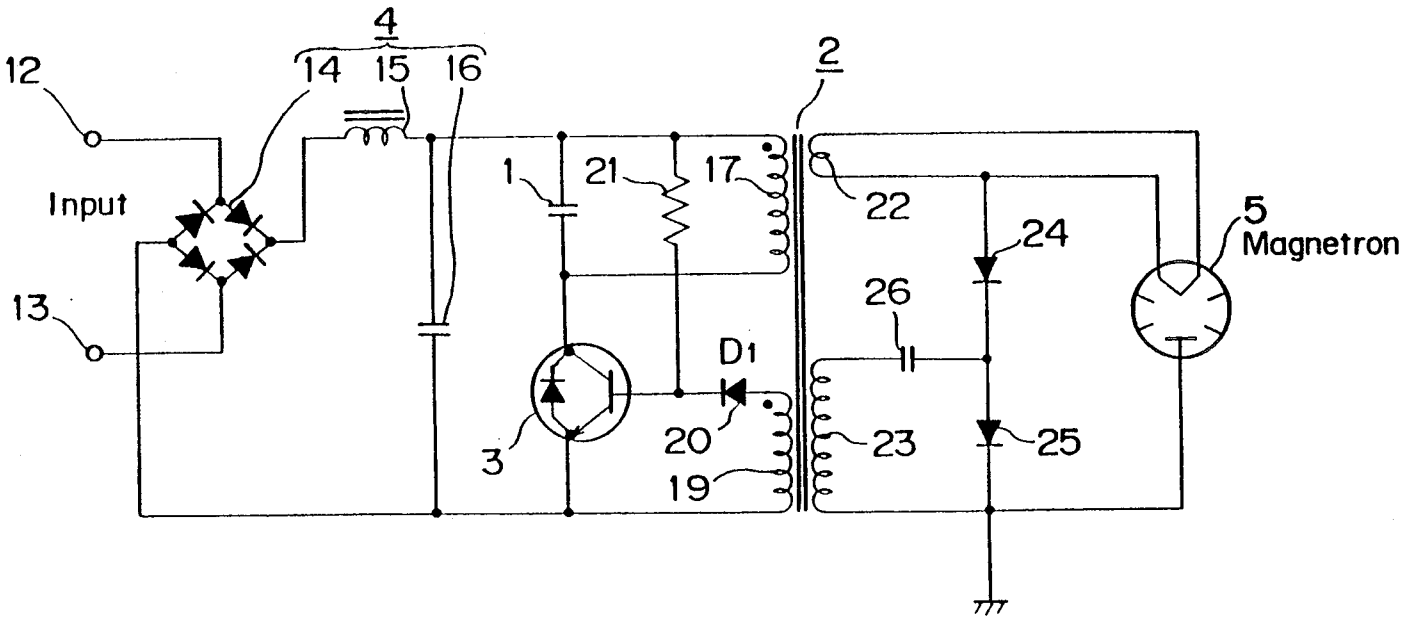
FIG. 1 is a circuit diagram of the switching power supply for microwave oven in a first embodiment according to the present invention.

FIG. 1 shows the first embodiment of the present invention, wherein the rectifying and smoothing circuit (4) comprising a full wave rectifier (14), an inductor (15), and a capacitor (16), is coupled to AC power input terminals (12) and (13). Between the ends of the capacitor (16) there is provided a serial circuit of a primary winding (17) of the inverter transformer (2) and transistor (3) with flywheel diode, which works as the switching element. The resonance capacitor (1) is coupled in parallel to the primary winding (17). The inverter transformer (2) has supplementary winding (19), and one end of the supplementary winding (19) is coupled to a base of the transistor (3) through a diode (20) and the other end is coupled to an emitter of the transistor. A resistor (21) which works as the starting circuit is inserted between the base of the transistor (3) and one end of the capacitor (1).

Diodes (24) and (25), a capacitor (26), and the magnetron (5) are coupled to secondary windings (22) and (23) of the inverter transformer (2).

Operation of the above mentioned structure will be explained as below.

AC voltage which is inputted to terminals 12–13 is rectified by the rectifying and smoothing circuit (4) and is stored in the capacitor (16). Then, a starting current is added to the base of the transistor (3) through the starting resistor (21), thereby turning on the transistor (3). A collector current of the transistor (3) increases linearly due to the inductance of primary winding (17) of the inverter transformer (2) coupled thereto in series, thereby generating at the same time a voltage having same phase in the supplementary winding (19) provided on the inverter transformer (2). The generated voltage is rectified by the diode (20) to increase the base current of the transistor (3), thereby further promoting the ON state of the transistor (3).

The collector current of the transistor (3) continues to increase linearly by the inductance of the inverter transformer (2). At the time when the current becomes equal to the value found by multiplying the base current to be supplied by the supplementary winding (19) by Hfe of the transistor (3), the base current ends, thereby stopping further increments of the collector current. Then, the transistor (3) is cut off suddenly to turn off. Although a flyback voltage generates in the inverter transformer (2), it is lowered when the above described sequence is terminated. When the flyback voltage becomes lower than Vin, a positive voltage generates in the supplementary winding (19), thereby again turning on the transistor (3).

As mentioned above, since the ON or OFF state of the transistor (3) is established by the self-excited oscillation action of the primary winding (17) which is electro-magnetically coupled to the inverter transformer (2) and the supplementary winding (19) after the starting caused by the starting resistor (21), it is possible to obtain very stable oscillation. And, as to the secondary winding of the inverter transformer (2), (22) is a heater winding for supplying a filament current of magnetron (5), and (23) is a high voltage winding for supplying anode current by oscillating magnetron (5).

Figure 2:
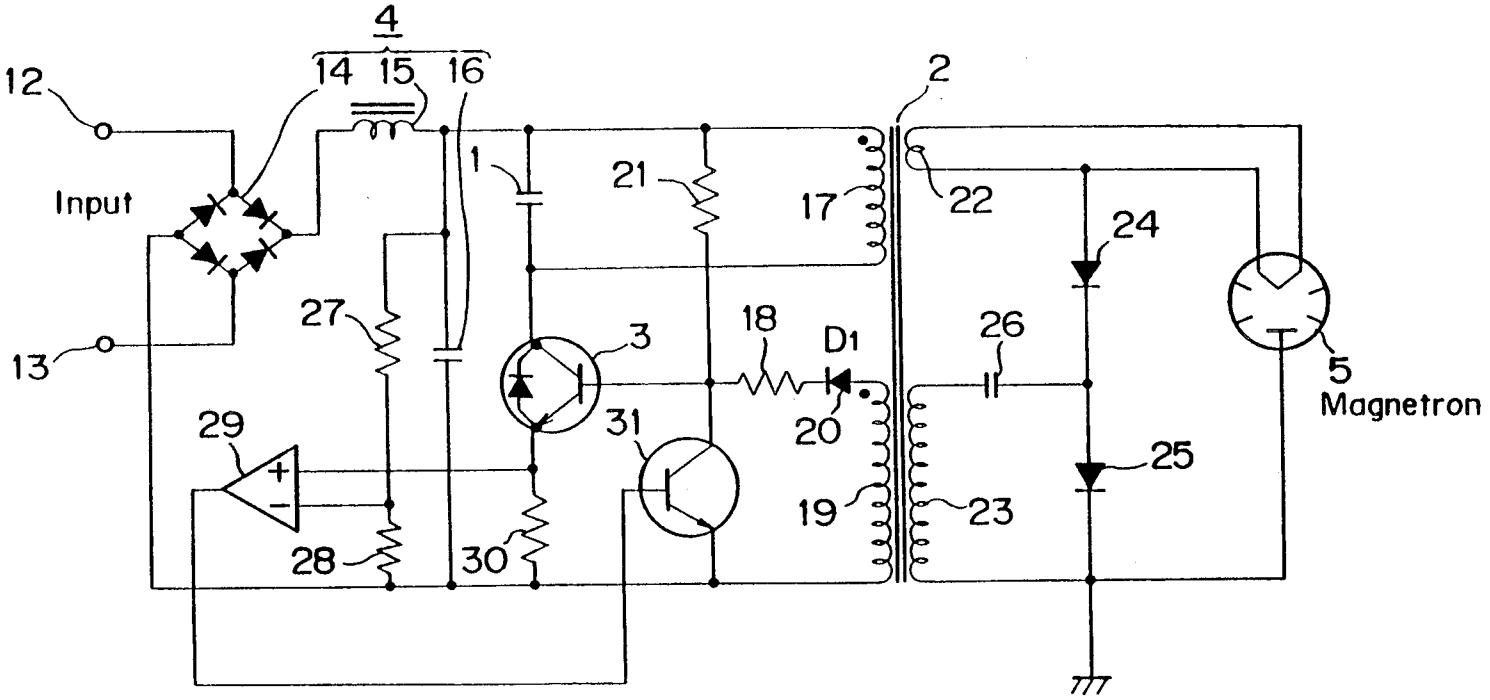
FIG. 2 is a circuit diagram of another embodiment of the present invention.

FIG. 2 shows another embodiment of the present invention, wherein excessive current of the main transistor (3) is prevented and the output power is stably controlled by a current mode action of the inverter circuit. Namely, the input voltage is divided into two resistors (27) and (28). The resulting reference voltage, which is changed in response to such input voltage, is inputted to one terminal of a comparator (29). Further, the current of the main transistor (3) is detected by a resistor (30) coupled to the emitter of the transistor (3) and is compared with the reference voltage by inputting it to another terminal of the comparator (29). The current reaches the level defined by the input voltage and is outputted from the comparator (29), thereby turning on the supplementary transistor (31) between the base and emitter of the main transistor (3). Thereby, the main transistor (3) is turned off. By repeating such operation, it is possible to set a fixed value of the power to be supplied to the magnetron (5). Since the input current is not controlled directly but the output power is controlled by a very small signal, it is possible to control with a signal such as provided by a micro-computer. Since the efficiency improvement is achieved by making the capacity of the smoothing capacitor (16) small in order to reduce the input current, it needs to activate the starting circuit at every half cycle of the commercially available input voltage.

Therefore, in the circuit using the starting resistor (21), the starting time within the commercial half cycle changes significantly, due to the value of Hfe of the main transistor (3).

Figure 4:
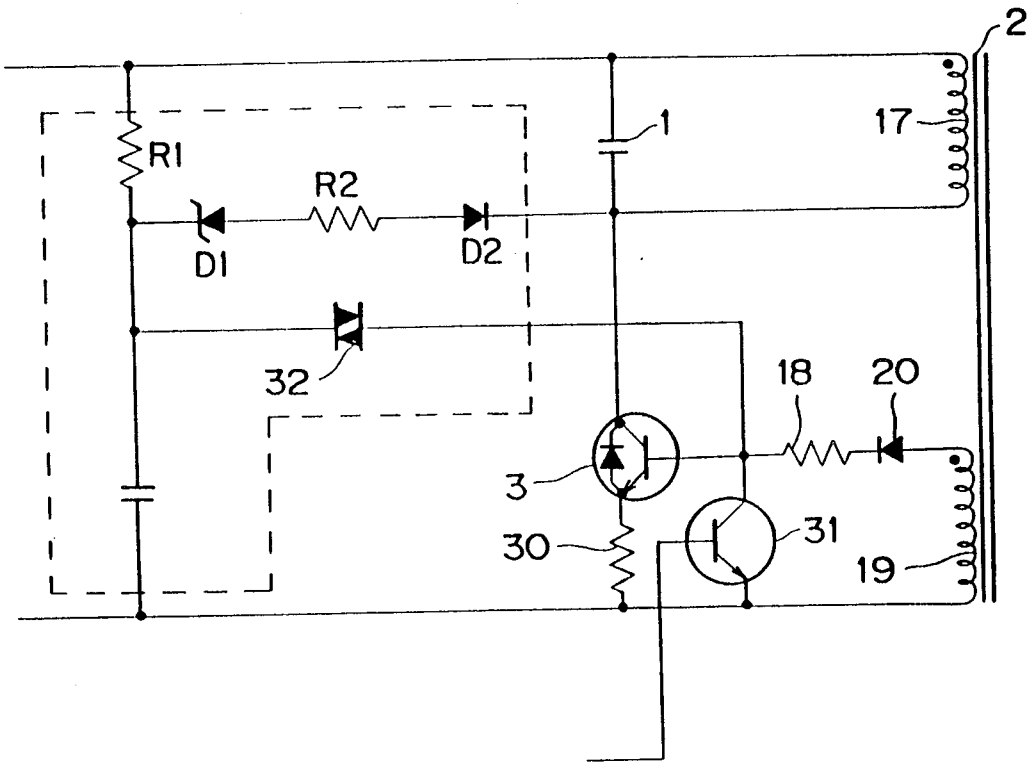
FIG. 4 is a circuit diagram for improving starting.
Figure 5:
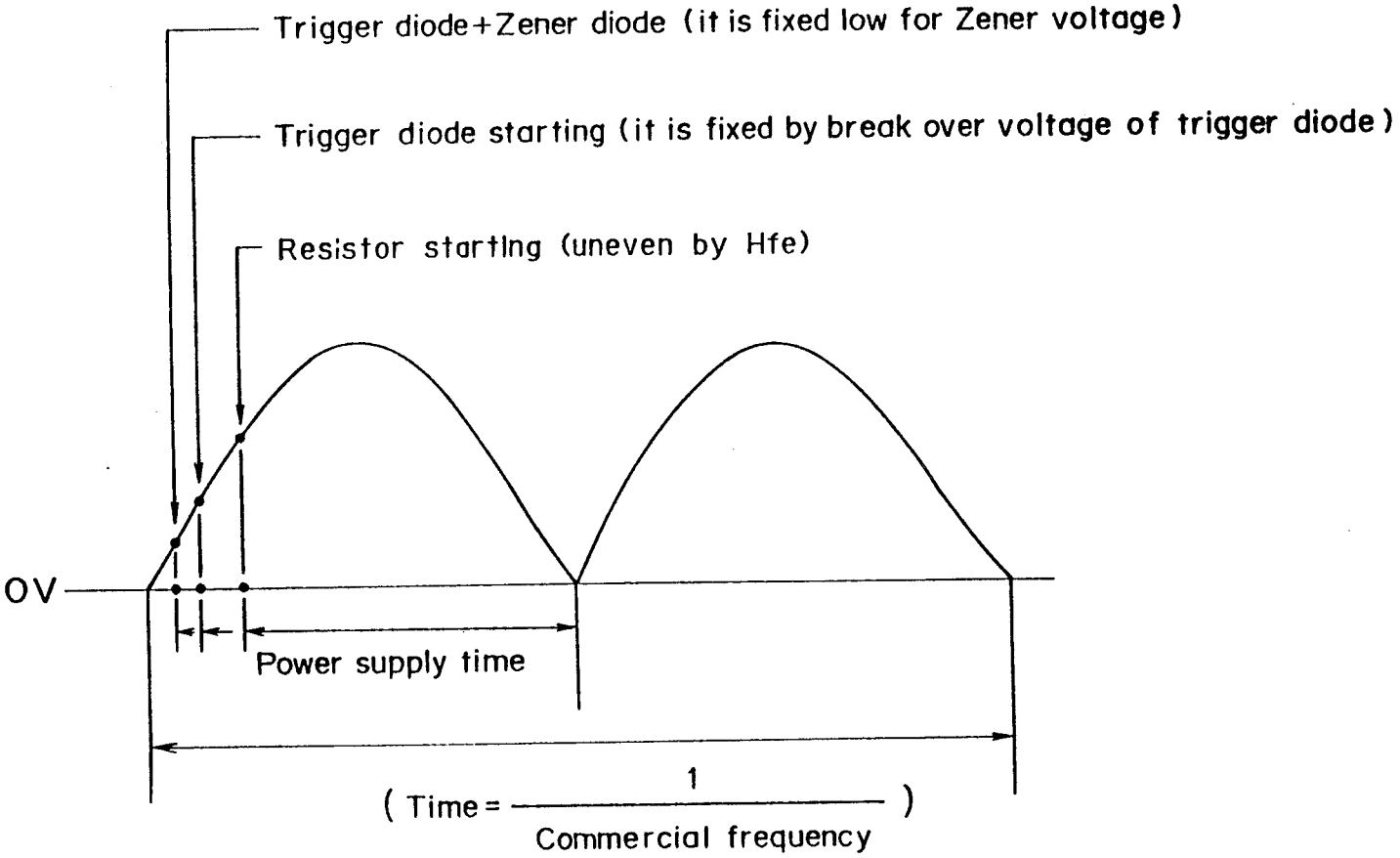
FIG. 5 shows a waveform at the time of starting.

In order to prevent such large change, the circuit of FIG. 2 may be modified as shown in FIG. 4. In FIG. 4 a bidirectional trigger diode (32) is used to establish a fixed period of starting conduction at every cycle of the input voltage, as shown in FIG. 5, thereby shortening the time until operation begins, thereby further realizing stable operation.

Figure 3:
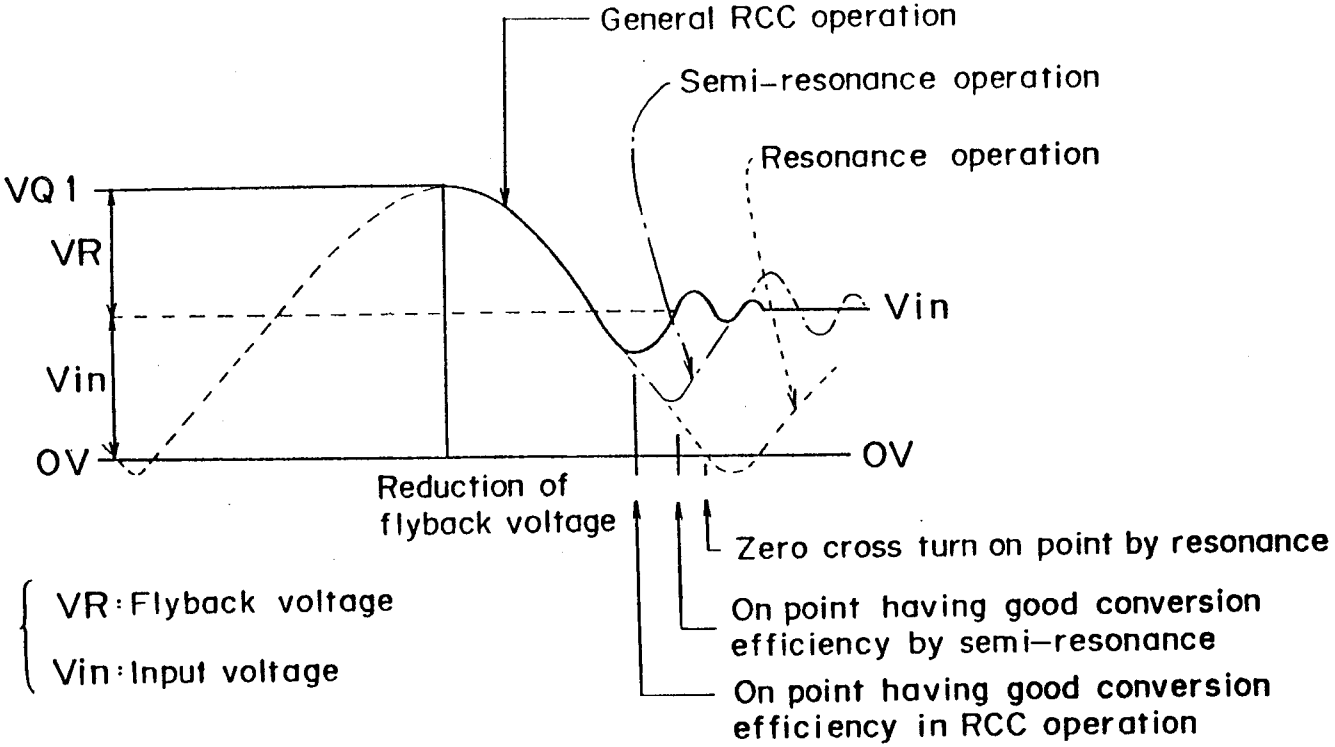
FIG. 3 shows a waveform at the time of moving to the voltage resonance type of the RCC circuit.

Prior to explaining details of operation of FIG. 4, reference is made to FIG. 3 which describes operation of an ordinary ringing choke converter (RCC). In such a converter, a series circuit consisting of a capacitor called the CR absorber and a resistor is connected in parallel to a transformer, and the flyback voltage generated while the switch element is off will converge to the input voltage Vin at a specific attenuation amplitude through the process of its decrease accompanying the ringing. Thus, in the case of RCC, the circuit with the highest conversion efficiency can be obtained by turning on the switching element when the flyback voltage has dropped to its lowest point.

In dealing with semi-resonant action, in order to control the surge voltage at the time of the turning off of the switching element, like the case of the RCC, a CR absorber is installed between the windings of the transformer to form a parallel resonance circuit with the inductance L between the windings and the capacitance of the CR absorber.

Thus, the attenuation amplitude of the flyback voltage becomes larger than that of the preceding RCC, whereby the loss of the switching element can be made smaller than that of the RCC by turning on the switching element when the flyback voltage has dropped to the point lower than that of RCC, thereby creating a circuit with high conversion efficiency.

In dealing with the resonant action, a resonance capacitor CR is parallelly connected between the windings of the transformer. When the characteristic impedance $Z=\sqrt{(LR/CR)}$ is increased, the flyback voltage can be made to rise by selecting the appropriate constant for the parallel resonance circuit consisting of the inductance LR of the winding and resonant capacitor CR, and this causes the attenuating amplitude to Vin to become larger than that in the case of the semi-resonant action, thereby causing the flyback voltage to reach 0V.

Thus, when the switching element is turned on at the time when the flyback voltage has dropped to 0V, there results a circuit with conversion efficiency higher than that is available in the case of the semi-resonant action.

For the switching power source of the microwave oven, a film capacitor with a small value static capacitance has conventionally been used at the capacitor 16 shown in FIG. 2.

Thus, the terminal voltage of the capacitor 16 becomes a pulsating voltage which drops to almost 0V for each half cycle of the commercial power, so that the transistor 3 needs to be restarted for each cycle of the commercial power.

FIG. 4 provides a starting circuit in place of the resistor 21 shown in FIG. 2. The circuit operates as follows.

C1 is charged in half a cycle of the input-voltage at a time constant determined by R1 and C1, and when the voltage exceeds the breakover voltage of the trigger diode 32, the charge on capacitor C1 is delivered to the base of the transistor 3.

After starting, the stop circuit of trigger diode 32, including D1, R2 and D2, will be actuated to cause a drop of C1 voltage and a resulting termination of the signal generation.

When the voltage as the sum of the Zemer voltage of diode D1 and voltage D2 is set a little lower than that of the breakover voltage of the trigger diode 32, the voltage of C1 will not drop to 0V even if the start/stopping circuit is actuated, and the time required for charging C1 can be reduced at the next half cycle of the commercial power. Thus, the starting voltage is every half cycle of the commercial power can be made lover than that in the case where Zener diode D1 is not provided.

FIG. 5 shows the voltage point of each of the above described circuits at which the operation starts as to each half cycle of the commercial power. In the case of the basic circuit shown in FIG. 2, the operation is started by resistor 21, so that the operation cannot be started unless the pulsating voltage becomes higher than that available in the case where the trigger diode is used.

Compared with the case where Zener diode D1 is absent, the voltage of the capacitor C1, the energy source of the trigger diode 32, can be held at a charged level a little lower than the sum of the breakover voltage of the trigger diode 32 and the voltage of the diode in the series-connection circuit, so that the restarting voltage can be set further lower; the power transmission time in every half cycle of commercial power can be made longer: and thus the power source circuit with high utilization efficiency can be formed.

Figure 6:
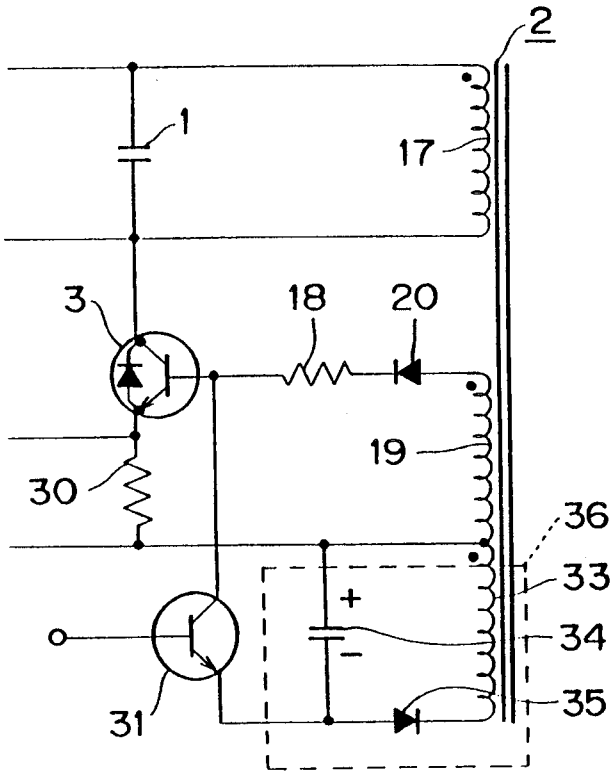
FIG. 6 is a circuit diagram for improving efficiency.
Figure 7:
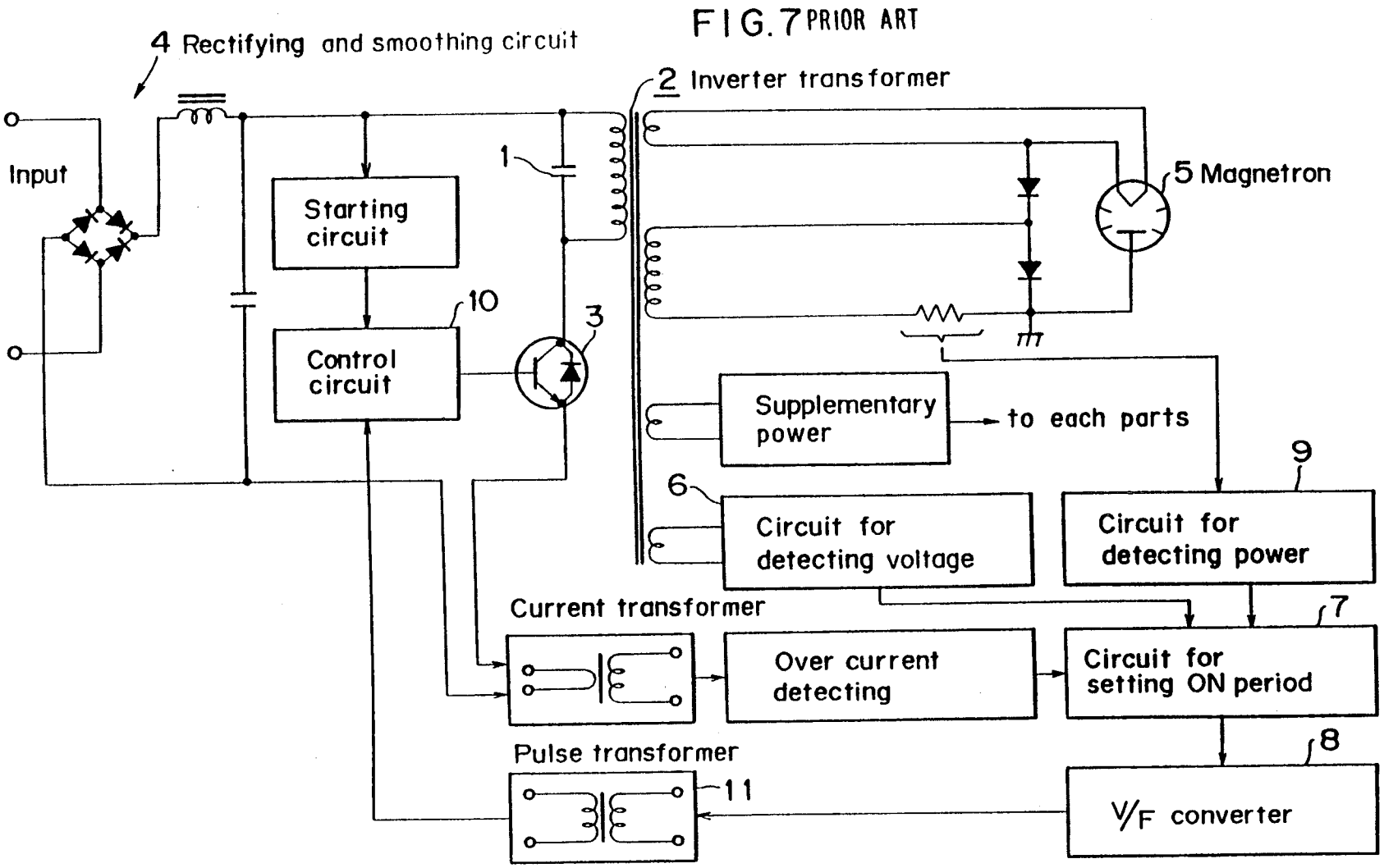
FIG. 7 PRIOR ART
FIG. 7 is a block diagram of the switching power supply for the conventional microwave oven.

FIG. 6 shows a circuit designed to provide the reverse bias with the previously provided negative power source in order to increase the turning off speed of the transistor 3. Compared with the circuit for short-circuiting between the base and the emitter of the transistor 3 in the circuit shown in FIG. 2, said circuit enables the transistor 3 to be turned off at a higher speed to form a circuit of higher conversion efficiency.

Further, as an applied example, in order to quicken the turn off of the main transistor (3), a circuit including a winding (33), a capacitor (34) and a diode (35) may be used as shown in FIG. 6 and a negative bias is applied thereto in order to improve the conversion efficiency.

What is claimed is:

1. A switching power supply for a microwave oven including a switching means for changing power from a DC source to a pulsed form, said switching means coupled to a primary minding of an inverter transformer supplying power to a magnetron, the magnetron coupled to a secondary winding of said inverter transformer, said switching means including a control input and said inverter transformer including a supplementary winding coupled to said control input of said switching means thereby providing a self-excited voltage resonance power source, wherein said switching means comprises a primary transistor having a base, an emitter and a collector, the collector being connected in a series connection with said inverter transformer and said supplementary winding being connected between the base and the emitter through a diode, further comprising reference means for generating a reference voltage by dividing an input voltage, comparator means, said reference means inputting said reference voltage to one terminal of said comparator means, a voltage detected by a resistor coupled to the emitter of said primary transistor being connected to another terminal of said comparator means, further comprising a supplementary transistor connected between the base and emitter of said primary transistor, an output of said comparator means connected to said supplementary transistor for turning on said supplementary transistor at a time when said detected voltage exceeds said reference voltage, thereby turning off said primary transistor.

2. A switching power supply for a microwave oven including a switching means for changing power from a DC source to a pulsed form, said switching means coupled to a primary winding of an inverter transformer supplying power to a magnetron, the magnetron coupled to a secondary winding of said inverter transformer, said switching means including a control input and said inverter transformer including a supplementary winding coupled to said control input of said switching means thereby providing a self-excited voltage resonance power source, wherein said switching means comprises a primary transistor having a base, an emitter and a collector, the collector being connected in a series connection with said inverter transformer and said supplementary winding being connected between the base and the emitter through a diode, further comprising reference means for generating a reference voltage by dividing an input voltage, comparator means, said reference means inputting said reference voltage to one terminal of said comparator means, a detected voltage representing current flowing in the primary winding of said inverter transformer being connected to another terminal of said comparator means, further comprising a supplementary transistor connected between the base and emitter of said primary transistor, an output of said comparator means connected to said supplementary transistor for turning on said supplementary transistor at a time when said detected voltage exceeds said reference voltage, thereby turning off said primary transistor.

* * * * *